US006622402B2

(12) United States Patent
Challande

(10) Patent No.: US 6,622,402 B2
(45) Date of Patent: Sep. 23, 2003

(54) SPORTS BOOT, ESPECIALLY SKI BOOT, PROVIDED WITH AN AUTOMATIC DEVICE FOR PIVOTAL IMMOBILIZATION OF THE UPPER

(75) Inventor: Christian Challande, Cruseilles (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 10/050,919

(22) Filed: Jan. 22, 2002

(65) Prior Publication Data

US 2002/0095822 A1 Jul. 25, 2002

(30) Foreign Application Priority Data

Jan. 24, 2001 (FR) ..... 01 01259

(51) Int. Cl.[7] ..... A43B 5/04; A43B 5/16

(52) U.S. Cl. ..... 36/118.7; 36/117.1; 36/118.2; 36/118.9

(58) Field of Search ..... 36/117.1, 117.2, 36/118.2, 118.3, 118.4, 118.7, 118.8, 118.9, 119.1

(56) References Cited

U.S. PATENT DOCUMENTS 4,880,251 A * 11/1989 Wulf et al. ..... 36/117.1
5,026,087 A * 6/1991 Wulf et al. ..... 36/117.1
5,086,573 A * 2/1992 Mabboux et al. ..... 36/117.1
5,412,883 A * 5/1995 Wulf et al. ..... 36/117.1
5,457,899 A * 10/1995 Chemello ..... 36/118.2
5,588,229 A * 12/1996 Marmonier ..... 36/118.9
5,857,271 A * 1/1999 Pallatin ..... 36/118.4
6,101,745 A * 8/2000 Grandin et al. ..... 36/118.7
6,131,313 A * 10/2000 Pierce et al. ..... 36/118.3

FOREIGN PATENT DOCUMENTS

| | | |
|---|---|---|
| EP | 0664969 | 8/1995 |
| EP | 0940096 | 9/1999 |
| EP | 1023847 | 8/2000 |
| WO | WO92/19117 | 11/1992 |

* cited by examiner

*Primary Examiner*—Anthony D. Stashick
(74) *Attorney, Agent, or Firm*—Greenblum & Berstein, P.L.C.

(57) ABSTRACT

A sports boot, especially a ski boot, including a shell base overlaid by an upper at least partially pivotal in relation to the shell base and including a device for locking and unlocking with respect to the latter, which is constituted by an abutment zone provided on the rear portion of the upper, and by an oscillating lever forming a rocker, arranged on the rear portion of the shell base, capable of cooperating in locking with the abutment, under the action of a control member, wherein the control member of the oscillating lever forming a rocker, adapted to cooperate in locking with the abutment, is located in the rear fitting zone of the boot so as to be biased by the rear binding of an element to be fitted, and is controllably connected to the lever, located at a distance, in a zone separate from the fitting zone, by means of a cable pulling on the lever during the fitting of the boot.

8 Claims, 4 Drawing Sheets

SPORTS BOOT, ESPECIALLY SKI BOOT, PROVIDED WITH AN AUTOMATIC DEVICE FOR PIVOTAL IMMOBILIZATION OF THE UPPER

CROSS-REFERENCE TO RELATED APPLICATION

This application is based upon French Patent Application No. 01 01259, filed Jan. 24, 2001, the disclosure of which is hereby incorporated by reference thereto in its entirety, and the priority of which is hereby claimed under 35 U.S.C. §119.

BACKGROUND OF THE INVENTION

1. Field of the Invention

The present invention relates to a sports boot, especially a ski boot, including a shell base overlaid by an upper having a front portion and a rear portion that are made in one or a plurality of pieces, the rear portion of the upper being at least partially pivotal in relation to the shell base and including a device for locking and unlocking with respect to the latter, active in a rear-to-front direction of pivoting of the rear portion of the upper. Such a device is constituted in a known fashion by an abutment zone provided on the rear portion of the upper, on the one hand, and by an oscillating lever forming a rocker, journalled on an axle, arranged on the rear portion of the shell base, perpendicular to its median vertical plane and capable of cooperating in latching with the abutment, under the action of a control member accessible from outside the boot, acting against a return spring of this lever, on the other hand.

2. Description of Background and Relevant Information

In a boot of the aforementioned type, the locking position of the lever corresponds to an initial reference advance position, from which the upper is adapted to move angularly along a predetermined amplitude in relation to the shell base.

To this end, locking and unlocking mechanisms of the aforementioned type are known from the documents EP 0 940 096 and EP 0 664 969, in which an oscillating lever forming a rocker is controlled directly by a control member that is in fact constituted, in both cases, by the rear binding of an element to be fitted, such as a ski.

This has the major disadvantage of placing these levers in the lower portion of the shell base, so as to control them at right angles with their pivoting axes.

However, this rear zone of the boot, intended for the binding, is standardized and must theoretically remain free, in order to comply with the ISO 5355 Standard.

Contradictorily, the presence of the lever implies creating a protuberance in this zone for its housing and journal, which, in order to comply with this standard, involves forward shifting of the entire remainder of the boot, and consequently of the foot during skiing, which distorts the proprioception of the foot, hindering the front-to-rear balancing of the skier.

Of course, another solution could include considerably increasing the thickness of the wall of the boot in his zone for housing the lever, but this would weigh down the boot and would not prevent the forward shifting of the foot to comply with the aforementioned standard.

SUMMARY OF THE INVENTION

An object of the present invention is to remedy the aforementioned various disadvantages of the prior art. To his end, the invention relates to a sports boot, especially a ski boot, including a shell base overlaid by an upper having a front portion and a rear portion that are made in one or more pieces, the rear portion of the upper being at least partially pivotal in relation to the shell base and including a device for locking and unlocking with respect to the latter, which is active in a rear-to-front direction of pivoting of the rear portion of the upper, and which is constituted by an abutment zone provided on the rear portion of the upper, on the one hand, and by an oscillating lever forming a rocker, journalled on an axle, arranged on the rear portion of the shell base, perpendicular to its median vertical plane and capable of cooperating in locking with the abutment, under the action of a control member accessible from outside the boot, acting against a return spring of the lever, on the other hand, the locking position of the latter corresponding to an initial reference advance position, from which the upper is adapted to move angularly along a predetermined amplitude in relation to the shell base, wherein the control member of the oscillating lever forms a rocker, adapted to cooperate in locking with the abutment, which is located in the rear fitting zone of the boot so as to be biased by the rear binding of an element to be fitted, and is controllably connected to the lever, located at a distance, in a zone separate from the fitting zone, by means of a cable pulling on the lever during the fitting of the boot in order to cause its rotation toward the abutment of the upper, and consequently its automatic locking, or inversely to cause its unlocking by releasing the control member during the removal of the boot, consequently causing the return of the cable by means of at least one elastic return member.

A significant advantage procured by the invention lies in that the cable can pass in any area of the shell base, in particular toward its lateral surfaces, therefore outside the standardized zone. But this can also remain in the median plane of the rear zone of the shell base, because the cable, whose space requirement is minimal, can be incorporated therein, and also because the rocking lever is arranged in a zone that is remote from the standardized zone.

Another advantage lies in that the entire device can be very easily designed to be impervious, unlike the known device of the prior art which can cause water to rise between the upper and the shell.

The present invention also relates to the characteristics which will become apparent from the description that follows, and which must be considered separately or according to all of their technical combinations,

BRIEF DESCRIPTION OF DRAWINGS

This description, provided by way of a non-limiting example, will help to better understand how the invention can be embodied, with reference to the annexed drawings, in which.

DETAILED DESCRIPTION OF THE INVENTION

Figure 1:
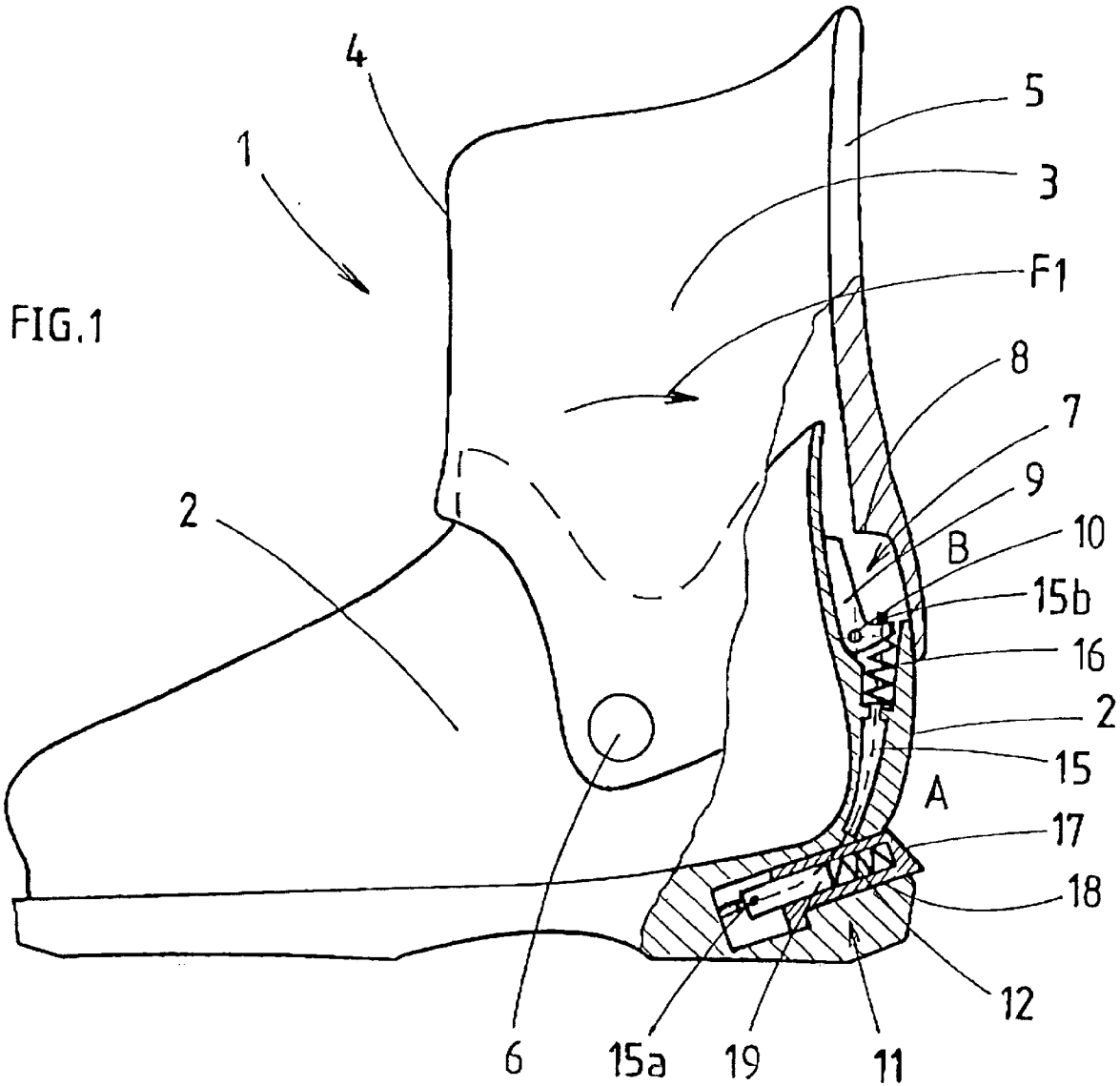
FIG. 1 schematically shows a lateral view of a ski boot, with a rear tear showing the immobilizing device according to the invention in the unlocking position, thereby allowing walking.
Figure 2:
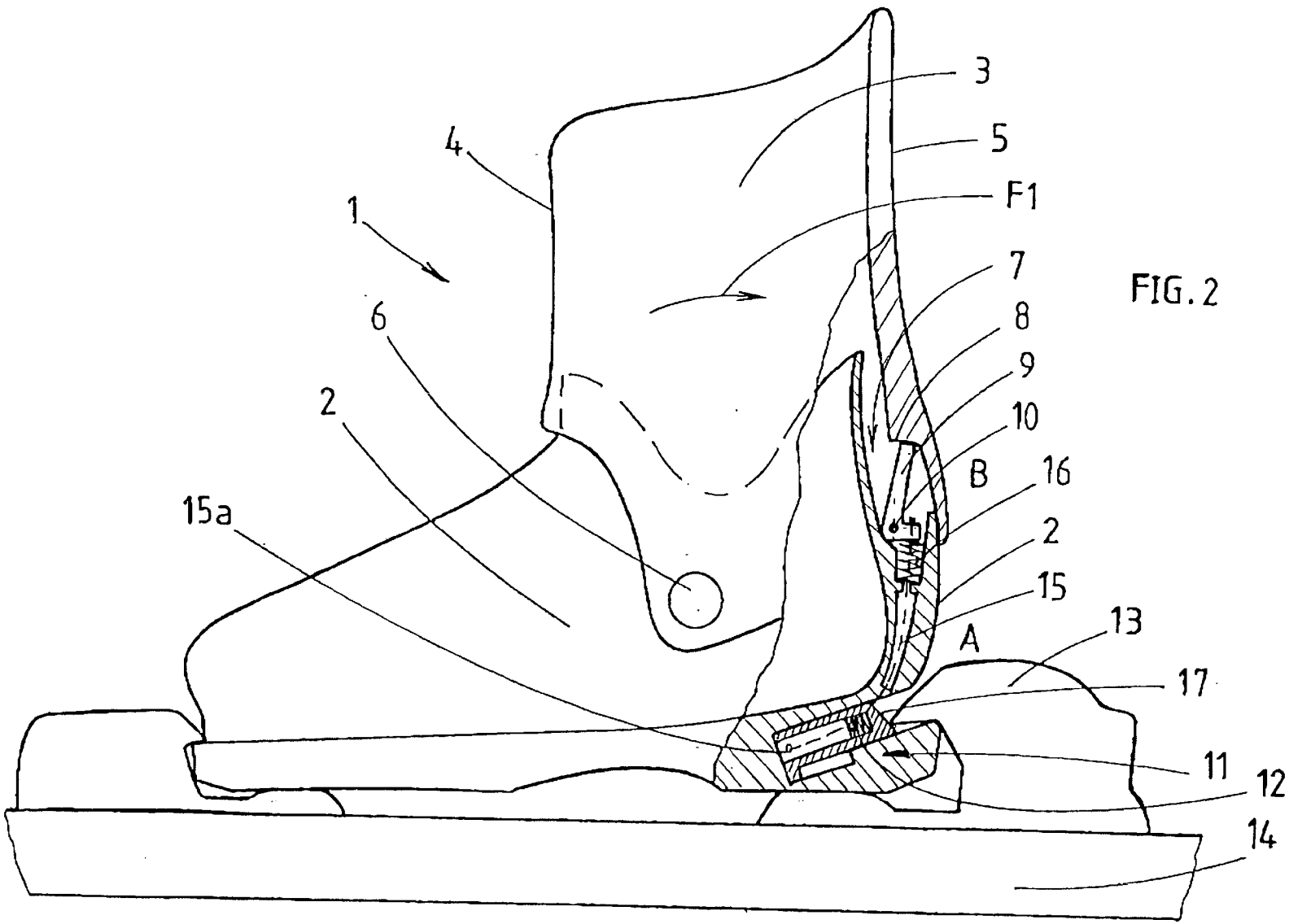
FIG. 2 schematically shows a lateral view of a boot mounted on a ski, with a rear tear showing the immobilizing device according to the invention in the locking position, thereby allowing siding.
Figure 3:
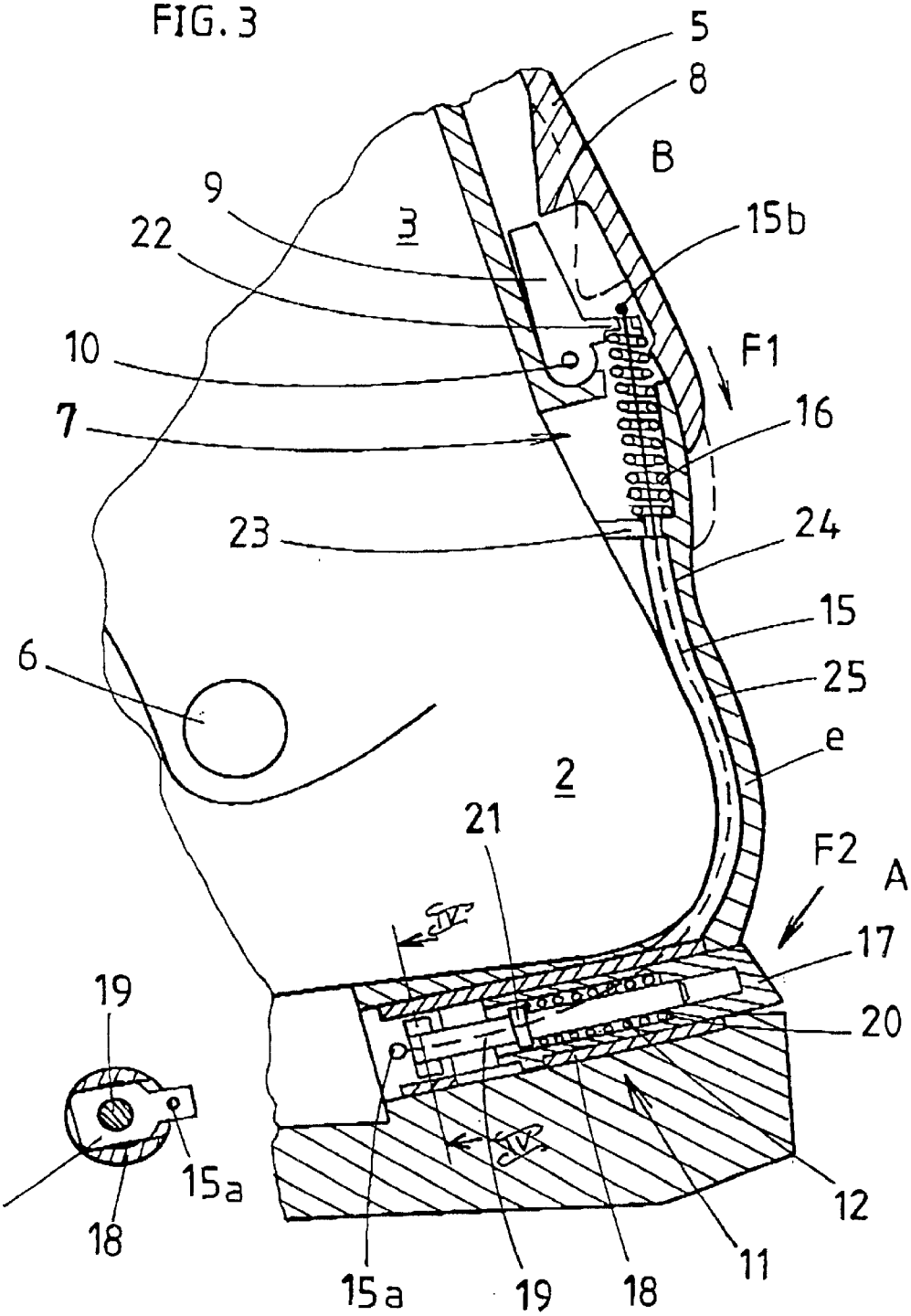
FIG. 3 is an enlarged view of the immobilizing device according to FIG. 1, in the unlocking position.

The boot generally designated by the reference numeral 1 in FIGS, 1 and 2 is, by way of a non-limiting example, a ski boot including a shell base 2 overlaid by an upper 3 having a front portion 4 and a rear portion 5 that are made in one or more pieces.

The rear portion 5 of the upper 3 is at least partially pivotal in relation to the shell base 2 due to rivets 6.

A system (not shown) for tightening and closing the upper 3 at several points on the lower leg of the skier includes, for example, known tension levers tensioning tractive elements, such as buckles/loops or cables, partially surrounding the upper at its front portion 4 so as to be tensioned by the tension levers fixed, for example, on the lateral wings coming from the rear portion for two levers, and on the front portion of the boot for a third lever.

Within the scope of the invention, these tightening and closure mechanism could be different.

The boot 1 also includes a device 7 for locking and unlocking in relation to shell base 2, which is active in a front-to-rear pivoting direction F1 of the rear portion 5 of the upper 3.

This device 7 is constituted of an abutment zone 8 provided on the rear portion 5 of the upper 3, on the one hand, and by an oscillating lever 9 forming a rocker, journalled on an axle 10 arranged on the rear portion of the shell base 2, perpendicular, or substantially perpendicular, to its median vertical plane and capable of cooperating in locking with the abutment 8 under the action of a control member 11, on the other hand.

This member 11 can be accessed from outside the boot 1 and acts against a return spring 16 of the lever 9.

The locking position of the latter corresponds to an initial reference advance position, from which the upper 3 is adapted to move angularly along a predetermined amplitude in relation to the shell base 2.

According to the invention, the control member 11 of the oscillating lever 9 forming a rocker, adapted to cooperate in locking with the abutment 8, is located in the rear fitting zone A of the boot 1 so as to be biased by the rear binding 13 of an element 14 to be fitted, in this case a ski, The member 11 is controllably connected to the lever 9, located at a distance, in a zone B separate from the fitting zone A, by means of a cable 15 pulling on the lever 9 during the fitting of the boot in order to cause its rotation toward the abutment 8 of the upper 3, and consequently its automatic locking, or inversely to cause its unlocking by releasing the control member 11 during the removal of the boot, consequently causing the return of the cable 15 by means of at least one elastic return member.

According to the present embodiment, the control member 11 is constituted by a hollow cylindrical piston 17 capable of sliding in a sheath 18 housed in the rear fitting zone A of the boot 1 and cooperating with an internal piston rod 19, in either direction, by means of the elastic return member 12, the piston rod 19 being linked at its outward end to one of the ends 15*a* of the cable 15.

According to the embodiment shown in the drawing figures, the elastic return member 12 is constituted by a helical compression spring arranged concentrically between the inner bore of the piston 17 and the piston rod 19 and coming in support against an internal shoulder 20 of the bore of the piston 17, on the one hand, and against the collar 21 of the piston rod 19.

The other end 15*b* of the cable 15, with a predetermined length, is linked to a projection 22 of the lever 9 so as to exert a traction thereon, causing its rotation about its journal axis 10.

The device includes at least one elastic unlocking member 16 inserted between a surface of the projection 22 of the lever 9, opposite the abutment zone 8 of the upper 3, and a fixed edge 23 of the shell base 2 positioned at a lower level with respect to the projection 22, such that the spring 16 is biased in compression during a traction on the cable 15, ensuring the locking of the upper 3 and, conversely, in decompression during the unlocking, by exerting a return force on the lever 9, associated with that of the decompression of the spring 12 of the piston 17.

In this case, the elastic unlocking member 16 is also a helical compression spring.

Also, according to the invention, a second helical compression spring arranged on the other side of the projection 22 of the lever 9 can be envisioned. In that event, the two springs would then act opposingly, their states being alternately compressive or non-compressive depending upon whether a locking or unlocking operation is undertaken.

According to another characteristic of the invention, the cable 15 is of the "Bowden" type associated with a sheath 24. Indeed, tests have shown that cables of this type yield particularly favorable results.

According to one major advantage of the invention, the "Bowden" cable 15-24 is housed in a channel 25 having a substantially correspo the original thickness "e" of the shell base 2, in its median or lateral rear portion, and connecting the abutment zone B to the fitting zone A, one being located at a distance from the other.

Figure 4:
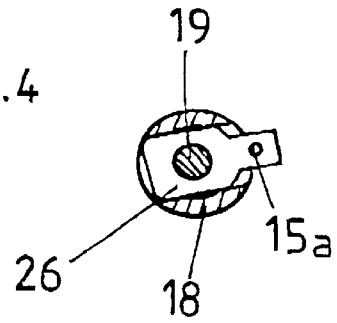
FIG. 4 is a cross-sectional view along the line IV—IV of FIG. 3.

As shown in FIG. 4, the end 15*a* of the cable 15 is connected to a piece 26 affixed to the piston rod 19.

Such a device enables the passage from a "skiing" position (upper locked in rear support) to a "walking" position (upper unlocked), and this occurring automatically by putting on or removing an apparatus equipped with a ski binding, stirrup, closure lever, etc. The operating principle is as follows:

- The piston 17 housed in the rear of the boot on the shell base 2 acts on the lever 9 by means of the piston rod 19 and the cable 15. This lever 9 allows blocking or not blocking the upper 3 in rear support.
- When fitting a binding jaw 13, or closure lever, or stirrup, the piston 17 moves back and pushes the piston rod 19 by the action of the spring 12, which causes a full traction of the cable 15 following a 3 mm backward movement of the piston 17, If the piston moves back further, the excess is absorbed by the piston spring.
- The traction of the cable 15 causes the rotational tilting of the lever 9, which causes the blocking of the upper 3. If the upper were already in the rear, the piston spring would compress completely.
- In fact, the lever 9 pivots upon the first forward bending of the upper 3.
- During the removal of the binding 13, therefore of the ski 14, the piston 17 comes out and the lever 9 enables the release of the upper 3 due to the action of the unlocking spring 16 arranged at the level of the lever 9.
- In the case of a blocking, the lever 9 pivots necessarily due to the action of its spring 16, and this after a forward bending of the upper 3.

Figure 5:
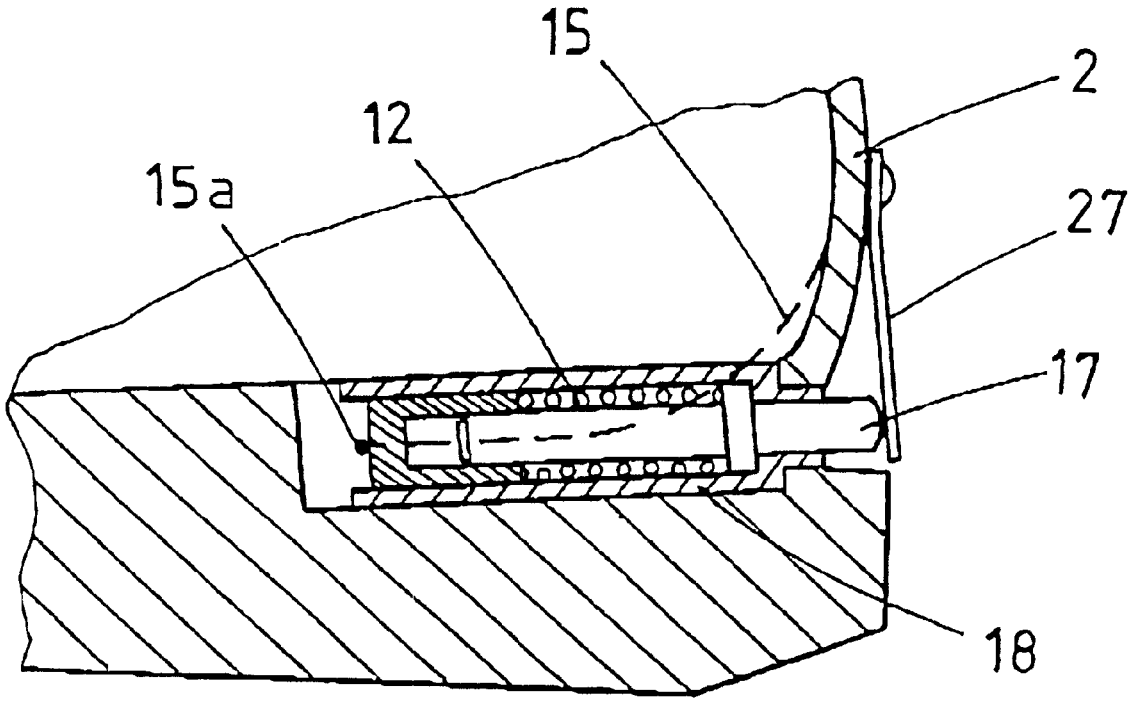
FIG. 5 shows an alternative embodiment at the level of the control member.

According to an alternative embodiment shown in FIG. 5, so as to improve the functioning of the device, the backward movement of the piston is ensured by the binding and by means of an elastic blade 27 arranged on the rear portion of the shell base 2 to cover the piston 17, thus enabling a smooth functioning with a jaw 13 having a very vertical slope and the use of a smaller piston 17.

This also has the advantage of offering a volume gain.

What is claimed is:

1. A sports boot, especially a ski boot, comprising:

a shell base and an upper overlying said shell base, said upper having a front portion and a rear portion made in one or more pieces, said rear portion of the upper being at least partially pivotal in relation to the shell base and comprising a device for locking and unlocking with respect to the shell base, which is active in a front-to-rear direction of pivoting of the rear portion of the upper, and which comprises an abutment zone provided in the rear portion of the upper, and by an oscillating lever forming a rocker, journalled on an axis, arranged on the rear portion of the shell base, substantially perpendicular to a vertical median plane and capable of cooperating in locking with the abutment, under the action of a control member accessible from outside the boot, acting against a return spring of said lever, the locking position of the latter corresponding to an initial reference advance position, from which the upper is adapted to move angularly along a predetermined amplitude in relation to the shell base, wherein the control member of the oscillating lever forming a rocker, adapted to cooperate in locking with the abutment, is located in the rear fitting zone of the boot so as to be biased by the rear binding of an element to be fitted, and is controllably connected to said lever, located at a distance, in a zone separate from the fitting zone, by means of a cable pulling on the lever during the fitting of the boot in order to cause its rotation toward the abutment of the upper, and consequently its automatic locking or, conversely, to cause its unlocking by releasing said control member during the removal of the boot, consequently causing the return of the cable by means of at least one elastic return member.

2. A boot according to claim 1, wherein the control member is constituted by a hollow cylindrical piston capable of sliding in a sheath housed in the rear fitting zone of the boot and cooperating with an internal piston rod, in either direction, by means of the elastic return member, the piston rod being linked at its outward end to one of the ends of the cable.

3. A boot according to claim 2, wherein the elastic return member is constituted by a helical compression spring arranged concentrically between the inner bore of the piston and the piston rod and coming in support against an internal shoulder of the bore of the piston and against a collar of the piston rod.

4. A boot according to claim 1, wherein the other end of the cable, with a predetermined length, is linked to a projection of the lever so as to exert a traction thereon, causing its rotation about its journal axis.

5. A boot according to claim 4, further comprising at least one elastic unlocking member inserted between a surface of the projection of the lever, opposite the abutment zone of the upper and a fixed edge of the shell base, obtained at a lower level with respect to the projection, such that said spring is biased in compression during a traction on the cable, ensuring the locking of the upper and, conversely, in decompression during the unlocking, by exerting a return force on the lever associated with that of the decompression of the spring of the piston.

6. A boot according to claim 5, wherein the elastic unlocking member is a helical compression spring.

7. A boot according to claim 1, wherein the cable is of a "Bowden" type associated with a sheath.

8. A boot according to claim 1, wherein a "Bowden" cable is housed in a channel having a substantially corresponding cross-section, provided in an original thickness "e" of the wall of the shell base, in its median or lateral rear portion, and connecting the abutment zone to the fitting zone, one being located at a distance from the other.

* * * * *